US009211463B2

(12) United States Patent
Giveans

(10) Patent No.: US 9,211,463 B2
(45) Date of Patent: Dec. 15, 2015

(54) BODY POSITION FEEDBACK APPARATUS

(75) Inventor: M. Russell Giveans, Minnetrista, MN (US)

(73) Assignee: M. Russell Giveans, Minnetrista, MN (US)

( * ) Notice: Subject to any disclaimer, the term of this patent is extended or adjusted under 35 U.S.C. 154(b) by 1008 days.

(21) Appl. No.: 13/304,021

(22) Filed: Nov. 23, 2011

(65) Prior Publication Data

US 2013/0127623 A1 May 23, 2013

(51) Int. Cl.

| | |
|---|---|
| ***A63B 23/08*** | (2006.01) |
| ***A63B 23/10*** | (2006.01) |
| ***A63B 21/068*** | (2006.01) |
| ***A63B 71/00*** | (2006.01) |
| ***A63B 69/00*** | (2006.01) |
| ***A63B 71/06*** | (2006.01) |
| ***A63B 23/035*** | (2006.01) |
| ***A63B 23/04*** | (2006.01) |

(52) U.S. Cl.

CPC ..... *A63B 69/0059* (2013.01); *A63B 23/03508* (2013.01); *A63B 23/03541* (2013.01); *A63B 23/0405* (2013.01); *A63B 71/0622* (2013.01); *A63B 2069/0062* (2013.01); *A63B 2071/0072* (2013.01); *A63B 2071/0655* (2013.01); *A63B 2220/805* (2013.01); *A63B 2225/50* (2013.01)

(58) Field of Classification Search

CPC ..... A63B 21/068; A63B 21/1403; A63B 21/1423; A63B 21/1426; A63B 21/143; A63B 21/1476; A63B 23/0405; A63B 23/0458; A63B 23/0464; A63B 23/0494; A63B 2022/0092; A63B 2023/0411; A63B 2208/02; A63B 2208/0204; A63B 2208/0209; A63B 2208/0223; A63B 2230/62; A63B 2230/625; A63B 69/0057; A63B 69/0059; A63B 2069/0062; A43B 7/00; A43C 19/00

See application file for complete search history.

(56) References Cited

U.S. PATENT DOCUMENTS

| | | | | |
|---|---|---|---|---|
| 7,090,629 | B1 * | 8/2006 | Abbou | 482/148 |
| 7,955,230 | B1 * | 6/2011 | Al-Oboudi | 482/79 |
| 2011/0092336 | A1 * | 4/2011 | Fenton et al. | 482/8 |

* cited by examiner

*Primary Examiner* — Oren Ginsberg

(74) *Attorney, Agent, or Firm* — Skaar Ulbrich Macari, P.A.

(57) ABSTRACT

A body positioning feedback apparatus is securable to a foot or other body part for which it is beneficial to ensure proper alignment between body parts. The body positioning feedback apparatus may be implemented as a mechanical device or as an electronic device that provides visual, audio, and/or tactile feedback when the user is employing improper form. As a particular non-limiting example, the body positioning feedback apparatus can be used to assist users in performing stationary or walking lunges and single-legged and two-legged squats.

13 Claims, 4 Drawing Sheets

BODY POSITION FEEDBACK APPARATUS

TECHNICAL FIELD

This disclosure relates generally to exercise and therapeutic devices. More particularly, the disclosure relates to devices for promoting proper positioning of body parts.

BACKGROUND

In the performance of exercises for fitness or therapeutic purposes, proper positioning of a person's body parts is important. Improper positioning can result in inefficient exercise or, worse, potentially serious injury.

As a particular example, the single-leg lunge (both stationary and ambulatory) and single-legged and two-legged squat, are important movements in the rehabilitation of several lower extremity ailments, injuries, and post-surgical interventions. These movements are also important for developing lower extremity muscles, such as the gluteus, quadriceps, hamstrings, gastrocnemius, and others. Flexion of the knee joint while the foot is firmly planted on the ground is a common biomechanical movement in the daily lives of humans with at least one fully functional leg. When the knee is flexed and the center of mass of the body is lowered, a significant amount of muscle activation is required throughout the leg and with the trunk or core.

Single-leg lunges involve a down-and-up motion with the back foot planted on the ground. Ambulatory lunge sequences involve lunging forward, transferring one's weight to the front foot, bringing the back foot forward to the side of the lead foot, and then repeating the sequence with the opposite leg. These exercises, as well as two-legged squats, involve keeping the person's center of gravity far enough posteriorly that the knee of the lead leg or, for two-legged squats, both knees, does not cross above and over the vertical plane of the great toe.

When the knee crosses the vertical plane of the toes, a significantly higher amount of stretching, and stress, occurs at the patella tendon. This higher stress can cause unnecessary injury or pain with the knee joint and surrounding muscles and ligaments. In order to prevent injury, patients, athletes, or other individuals are encouraged to keep the gluteus as far back as possible, preventing the kneecap from crossing the vertical plane of the toes.

Keeping the kneecap behind the vertical plane of the toes is particularly important during the walking lunge. The walking lunge closely represents the movement involved in typical daily activities. In addition, the walking lunge involves core stabilization and lower extremity muscle activation. The dynamic movement pattern associated with the walking lunge is frequently prescribed for patients and athletes to perform on a regular basis on their own, when verbal cues and guidance from trained professionals is not available.

Accordingly, it would be beneficial to have a device that can be used during a walking lunge sequence or during similar movement patterns in which the front knee is flexed to approximately 90° and in which proper form is required. Preferably, such a device should be light weight and should be easy to secure to a foot.

SUMMARY OF THE DISCLOSURE

According to various example embodiments, a body positioning feedback apparatus is securable to a foot or other body part for which it is beneficial to ensure proper alignment between body parts. The body positioning feedback apparatus may be implemented as a mechanical device or as an electronic device that provides visual, audio, and/or tactile feedback when the user is employing improper form. As a particular non-limiting example, the body positioning feedback apparatus can be used to assist users in performing stationary or walking lunges and single-legged and two-legged squats.

In one embodiment, a body position feedback apparatus includes a vertical member having a first end portion and a second end portion. A cup-like structure is secured to the first end portion of the vertical member. A strap is secured to the cup-like structure and arranged to fit around a foot or shoe of a user.

In another embodiment, a body position feedback apparatus includes a transmitter module configured to be secured to a first location on a body of a user. The transmitter module includes an emitter configured to emit a beam of electromagnetic radiation. A receiver module is in communication with the transmitter module and configured to detect the beam. The receiver module is configured to be secured to a second location on the body of the user. The receiver module comprises a feedback module in communication with the receiver module. The feedback module is configured to provide feedback to the user based on whether the receiver module is detecting the beam.

Another embodiment is directed to a body position feedback apparatus comprising a detector module configured to be secured to a location on a body of a user. The detector module comprises a housing that houses an emitter configured to emit a beam of electromagnetic radiation and a receiver that is configured to detect the beam. A feedback module is in communication with the receiver and provides feedback to the user based on whether the receiver is detecting the beam.

The embodiments disclosed herein may realize certain benefits. For example, the body positioning feedback apparatuses disclosed herein can be used during a walking or ambulatory sequence. Because the apparatuses disclosed herein can be secured to a foot without coming between the foot and the ground while in use, the apparatuses do not interfere with the natural movement of the foot or other body parts. While the apparatuses are disclosed primarily in the context of a walking or ambulatory sequence, it will be appreciated that they can be employed in a range of similar or related movement patterns in a safe and efficient manner.

DETAILED DESCRIPTION

The disclosed subject matter is described with specificity to meet statutory requirements. However, the description itself is not intended to limit the scope of this patent. Rather, it is contemplated that the claimed subject matter might also be embodied in other ways, to include different elements or combinations of elements similar to the ones described in this document, in conjunction with other present or future technologies.

A body positioning feedback apparatus can be secured to a foot or other body part for which it is beneficial to ensure proper alignment between body parts. For example, the body positioning feedback apparatus can be used to assist users in performing stationary or walking lunges and single-legged and two-legged squats. In one embodiment, the body positioning feedback apparatus is implemented as a mechanical device. The mechanical device contacts the user's knee when improper form is employed, thereby providing both visual and tactile feedback. Alternatively, the body positioning feedback apparatus may be implemented as an electronic device that includes a sensor. When the sensor detects that the user's body parts are not properly aligned, the electronic device may provide visual, audio, and/or tactile feedback, such as a light, beep, or buzz, to the user.

Figure 1:
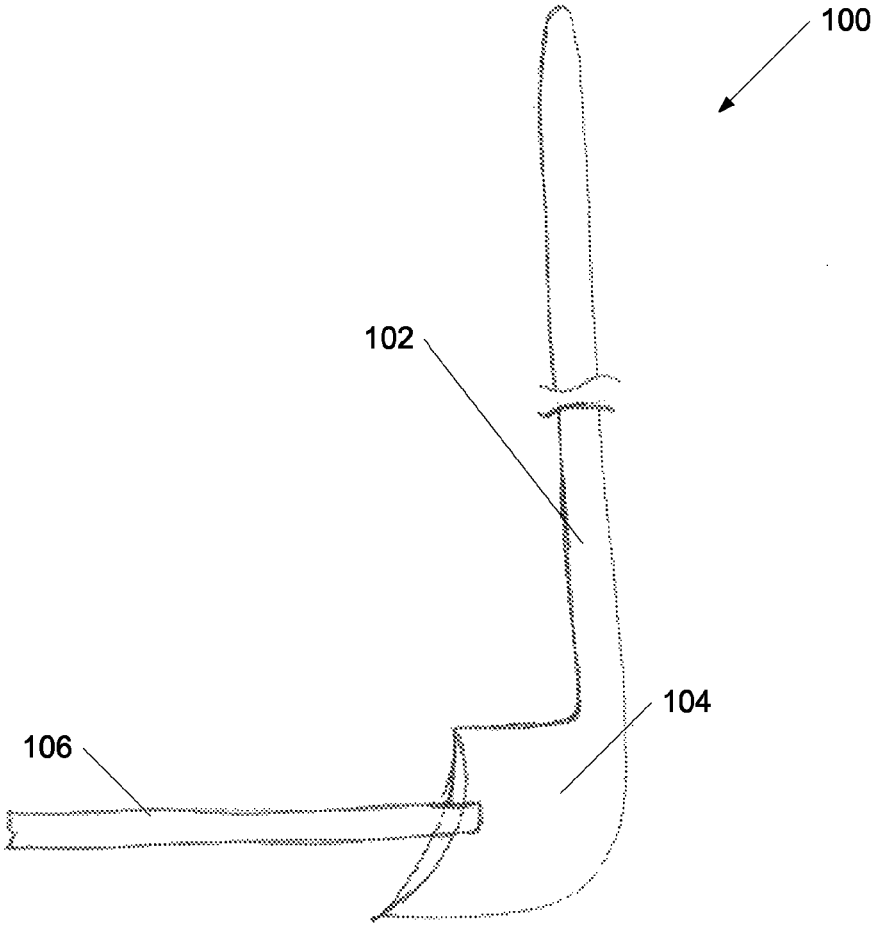
FIG. 1 is a plan view of a mechanical body position feedback apparatus according to one embodiment.

Referring now to the drawings, FIG. 1 depicts a mechanical body position feedback apparatus 100. The mechanical body position feedback apparatus 100 includes a vertical member 102 that, in use, extends from the user's foot to or slightly past the knee. The vertical member 102 may have a fixed length that is selected to accommodate a variety of knee heights. Alternatively, the length of the vertical member 102 may be adjustable, for example, by telescoping or by cutting the vertical member 102 to the proper length. In one particular embodiment, the length of the vertical member 102 can be adjusted between 6" and 24". As another alternative, the mechanical body position feedback apparatus 100 may be provided with a number of vertical members 102 of different lengths so that the user can select the vertical member 102 that best fits him or her. In one embodiment, for example, the mechanical body position feedback apparatus 100 is provided with vertical members 102 of five lengths: extra small, small, medium, large, and extra large. The vertical member 102 may have a width or thickness that is sufficient to allow it to be felt by the user when the user's knee contacts the vertical member 102. On the other hand, the width or thickness of the vertical member 102 should not be so large that it prevents the forward motion of the knee. Further, the vertical member 102 should be sufficiently flexible to yield slightly when the user's knee contacts the vertical member 102, but rigid enough to return to the upright position when contact has ended.

The vertical member 102 may be formed from any of a variety of materials, such as, for example, rubber, plastic, metal, wood, or foam. Other materials that are capable of maintaining an upright position while the user is walking may also be employed. It is desirable that the material that forms the vertical member 102 is safe in that it will not scratch, pierce, or cut the leg of the user during a squat or lunge motion or sequence.

In the embodiment shown in FIG. 1, one end of the vertical member 102 includes or is attached to a cup-like structure 104 that, in use, fits around a toe portion of the user's foot or shoe. The cup-like structure 104 restricts movement of the vertical member 102 relative to the user's foot or shoe. Preferably, the cup-like structure 104 covers only a relatively small portion of the toe portion of the user's foot or shoe. In the embodiment shown in FIG. 1, for example, the cup-like structure 104 is approximately 2-4 inches thick. Using a cup-like structure 104 of this size prevents the user from being distracted by feeling the cup-like structure 104 beneath his or her foot while walking or standing. In this way, the effect of the mechanical body position feedback apparatus 100 on the way the user's foot or shoe contacts the floor can be reduced. Similarly, the effect on the ground reaction force produced by the user can also be reduced. The mechanical body position feedback apparatus 100 may be provided with a number of cup-like structures 104 of different sizes to accommodate a variety of shoe sizes. As another alternative, the cup-like structure 104 may be formed from a flexible material, such as rubber or plastic, so that a single cup-like structure 104 can be used with a range of shoe sizes.

In some embodiments, the cup-like structure 104 is formed integrally with or molded to the vertical member 102. In other embodiments, the cup-like structure 104 may be attached to the vertical member 102 by a locking mechanism. As another alternative, the cup-like structure 104 may be screwed or snapped into the vertical member 102.

The vertical member 102 is secured to the user's foot or shoe, for example, using an adjustable strap 106 that fits around the user's heel when the mechanical body position feedback apparatus 100 is in use. The vertical member 102 may be secured to the user's foot or shoe using other mechanisms, such as, for example, an elastic strap or an adhesive. In some embodiments, an additional strap may be located over the top of the user's foot or shoe to enhance stability.

Figure 2:
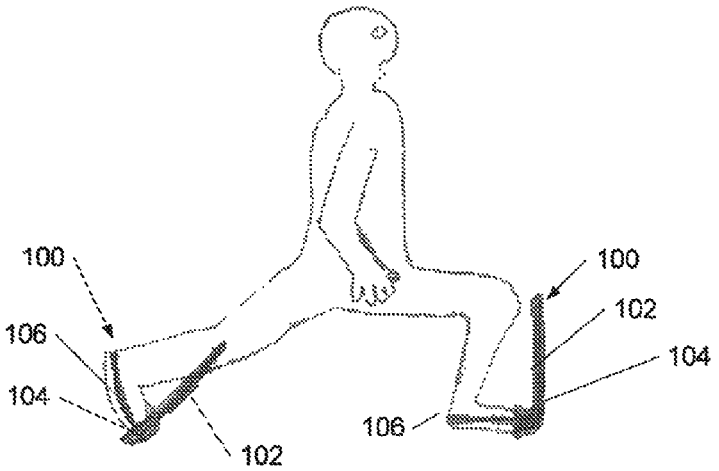
FIG. 2 illustrates the mechanical body position feedback apparatus of FIG. 1 as employed in a lunge exercise.
Figure 3:
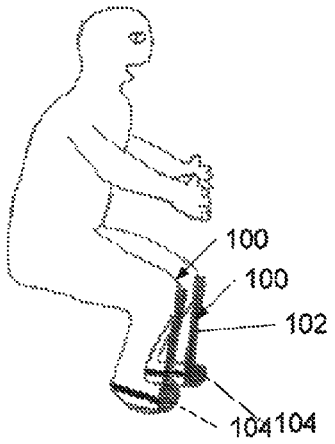
FIG. 3 illustrates the mechanical body position feedback apparatus of FIG. 1 as employed in a squat exercise.

FIGS. 2 and 3 depict a pair of mechanical body position feedback apparatuses 100 that are secured to each leg of a user for performing single-leg lunges and two-legged squats, respectively. Referring to FIG. 2, when the user is performing a lunge, the mechanical body position feedback apparatus 100 that is secured to a back leg 200 should be able to simply be perturbed by the back leg 200, which is extended during the lunge. That mechanical body position feedback apparatus 100 should then return to its physical uprightness or erectness when the back leg 200 is brought forward on a subsequent lunge.

Figure 4:
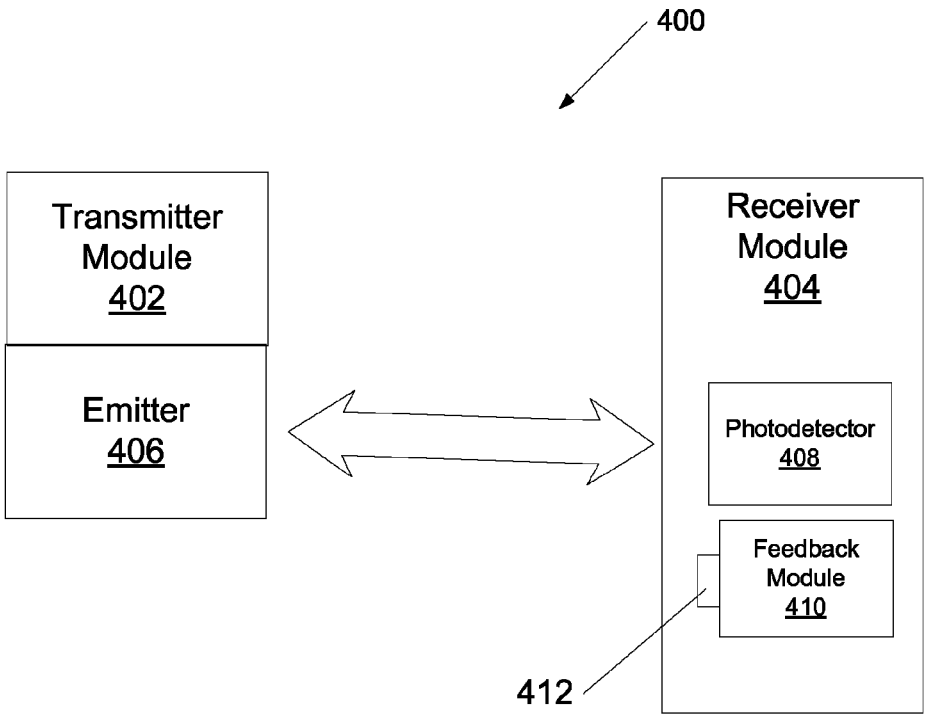
FIG. 4 is a block diagram illustrating an electronic body position feedback apparatus according to another embodiment.

In another embodiment, the body position feedback apparatus is implemented using electronic components. FIG. 4 is a block diagram depicting an electronic body position feedback apparatus 400. The electronic body position feedback apparatus 400 includes a transmitter module 402 and a receiver module 404. The transmitter module 402 includes an emitter 406 that emits a beam of electromagnetic radiation, such as, for example, visible or infrared light. The emitter 406 may be implemented as a light emitting diode (LED), a laser diode, or some other component that produces a beam of visible or infrared light.

The receiver module 404 includes a photodetector 408, such as, for example, a photoresistor, a photodiode, a phototransistor, or another optoelectronic component suitable for detecting the beam emitted by the emitter 406. The receiver module 404 also includes a feedback module 410 that provides the user with feedback when the photodetector 408 does not detect the beam from the emitter 406. Alternatively, the feedback module 410 could be configured to provide feedback when the photodetector 408 detects the beam from the emitter 406. A switch 412 may be used to configure the feedback module 410 to provide feedback either when the photodetector 408 detects the beam or when the photodetector 408 does not detect the beam. In either case, this feedback may be provided in any of a number of ways. For example, the feedback module 410 may include an LED or other visual indicator, a buzzer, speaker, or other audio output component, or a vibrator or other haptic feedback component. In some embodiments, the feedback module 410 may include a combination of these components. In other embodiments, the feedback module 410 may include a transmitter, such as a Bluetooth transceiver, that remotely activates a visual indicator, audio output component, or haptic feedback component carried or worn by the user or a trainer or otherwise monitored by the user or trainer.

In operation, the transmitter module 402 and the receiver module 404 are secured to locations on the user's body for which proper alignment is desired. For example, if the user is performing an exercise in which it is desirable to keep the user's elbows parallel to each other, the user may secure the transmitter module 402 and the receiver module 404 to or near the user's elbows. When the user's elbows are properly aligned, the receiver module 404 detects the beam that is emitted by the transmitter module 402. In response to the receiver module 404 detecting the beam, the feedback module 410 may provide feedback to the user to indicate that the user's elbows are properly aligned. Alternatively, the feedback module 410 may provide feedback when the receiver module 404 does not detect the beam to indicate that the user's elbows are out of proper alignment.

As another operational example, if the user is performing a lunge or squat, the user may secure the transmitter module 402 to the toe of his or her shoe and the receiver module 404 to his or her knee. If the user's knee crosses over his or her toe, the receiver module 404 will detect the beam emitted by the transmitter module 402. The feedback module 410 may then provide feedback to the user to indicate that his or her knee is improperly positioned. This feedback may incorporate a visual signal, an audio signal, and/or a haptic signal. Alternatively, the feedback module 410 can be configured to provide the feedback signal or signals as long as the receiver module 404 does not detect the beam emitted by the transmitter module 402. In this case, the feedback module 410 would provide feedback to the user as long as proper form is employed, but would stop providing feedback if the user employs improper form.

Figure 5:
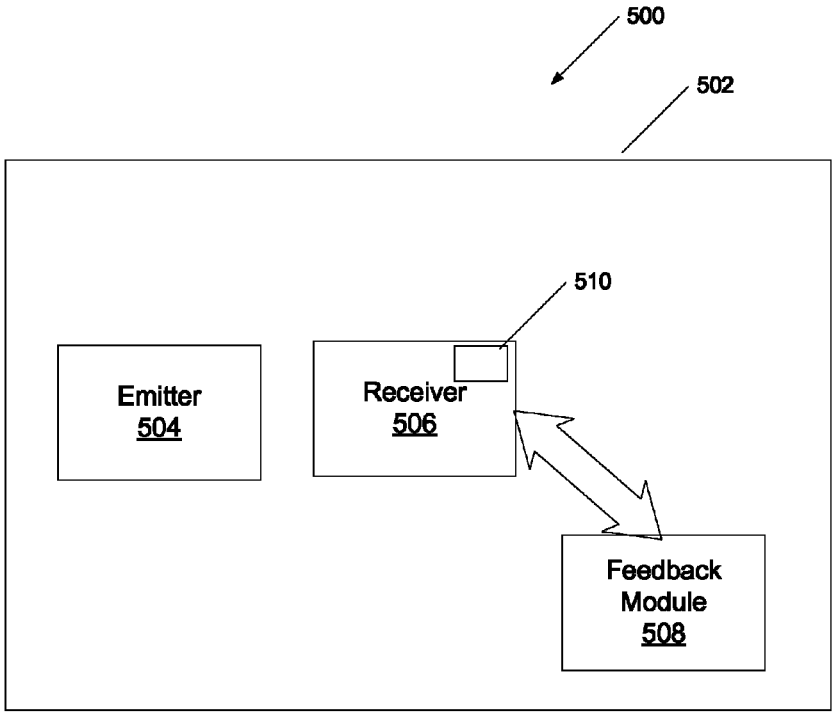
FIG. 5 is a block diagram illustrating another electronic body position feedback apparatus according to still another embodiment.

FIG. 5 is a block diagram depicting another example electronic body position feedback apparatus 500. The electronic body position feedback apparatus 500 includes a detector module 502 that can be secured to a location on a user's body. The detector module 502 includes a housing (not shown in the block diagram of FIG. 5) that houses an emitter 504 that emits a beam of electromagnetic radiation, such as, for example, visible or infrared light. The emitter 504 may be implemented as a light emitting diode (LED), a laser diode, or some other component that produces a beam of visible or infrared light. Also located in the housing is a receiver 506 that detects the beam when the beam is not interrupted. A feedback module 508 is in communication with the receiver 506 and is configured to provide feedback to the user based on whether the receiver 506 is detecting the beam. In some embodiments, the feedback module 508 is also located in the housing with the emitter 504 and the receiver 506. Alternatively, the feedback module 508 could be located in a separate component and could communicate with the receiver 506, for example, using a wireless communication link.

The receiver 506 includes a photodetector 510, such as, for example, a photoresistor, a photodiode, a phototransistor, or another optoelectronic component suitable for detecting the beam emitted by the emitter 504. The feedback module 508 provides the user with feedback when the photodetector 510 detects that the beam is obstructed or blocked, for example, by a body part of the user crossing a threshold plane. This feedback may be provided in any of a number of ways, such as the modalities described above in connection with the feedback module 410 of FIG. 4.

In operation, the electronic body position feedback apparatus 500 is secured to a location on the user's body for which proper alignment is desired. For example, if the user is performing an exercise in which it is desirable to keep the user's knees behind a threshold plane extending upward from the user's toes, the user may secure the electronic body position feedback apparatus 500 to or near the user's toes, pointing upward. When the user's knees cross the threshold plane defined by the user's toes, the photodetector 510 detects that the beam that is emitted by the emitter 504 is interrupted. In response to this condition, the feedback module 510 may provide feedback to the user to indicate that the user's knees are out of proper alignment.

As demonstrated by the foregoing discussion, various embodiments may provide certain advantages. For example, because the apparatuses disclosed herein can be secured to a foot without coming between the foot and the ground while in use, the apparatuses do not interfere with the natural movement of the foot or other body parts. By contrast, certain conventional devices employ a platform that is located between the user's foot or feet and the ground. When an object of any material or thickness, e.g., such a platform or a thin layer of rubber or plastic, the natural movement of the foot is altered in a number of ways. For instance, the vertical displacement between the foot and the ground becomes a factor in how safely and efficiently the user can move. In addition, the natural ground reaction forces caused by the user's body weight during a walking step change and may affect the way the user moves. With no material between the user's feet and the ground other than the user's shoes, if shoes are worn, these artificial modifications to the user's natural movements are at least substantially avoided.

It will be understood by those who practice the embodiments described herein and those skilled in the art that various modifications and improvements may be made without departing from the spirit and scope of the disclosed embodiments. The scope of protection afforded is to be determined solely by the claims and by the breadth of interpretation allowed by law.

What is claimed is:

1. A body position feedback apparatus comprising:

a flexible vertical member having a first end portion and a second end portion;

a cup-like structure secured to the first end portion of the vertical member the cup-like structure defining a circumferential wall defining a central aperture configured to engage a toe region of a shoe of a user, and the circumferential wall extending proximally toward the shoe such that a majority of the shoe protrudes proximally from the cup-like structure to permit a bottom surface of the shoe to contact a ground surface when the user performs either a squat or a lunge movement; and a strap secured to the cup-like structure and arranged to extend proximally from the circumferential wall to engage a portion of the shoe that protrudes proximally from the cup-like structure.

2. The body position feedback apparatus of claim 1, wherein the vertical member has a fixed vertical length.

3. The body position feedback apparatus of claim 1, wherein the vertical member has an adjustable vertical length.

4. The body position feedback apparatus of claim 1, wherein the cup-like structure is formed from a flexible material.

5. The body position feedback apparatus of claim 1, wherein the cup-like structure is formed integrally with the vertical member.

6. The body position feedback apparatus of claim 1, wherein the strap has an adjustable length.

7. The body position feedback apparatus of claim 1, wherein the strap is elastic.

8. The body position feedback apparatus of claim 1, further comprising a second strap configured to be located over a top of the foot or shoe of the user.

9. A body position feedback apparatus comprising:

a singular body comprising a vertical member portion and a toe engagement portion, the toe engagement portion defining a recess to secure a toe portion of a shoe of a user, the toe engagement portion including a forward wall portion to prevent the toe portion of the shoe of the user from extending horizontally forward of any portion of the vertical member portion and a base portion extending rearwardly from the forward wall portion, the base portion extending rearward such that a majority of a shoe of a user protrudes proximally from the toe engagement portion to permit a bottom surface of the shoe to contact a ground surface when the user performs either a squat or a lunge movement.

10. The apparatus of claim 9, wherein the vertical member portion extends straight vertically upward from the toe engagement portion.

11. The apparatus of claim 9, wherein the vertical member portion is flexible forwardly of the toe engagement portion.

12. The apparatus of claim 9, further comprising a shoe retaining strap secured to the toe engagement portion and arranged to extend proximally therefrom to engage a portion of the shoe of the user that protrudes rearwardly from the toe engagement portion.

13. The apparatus of claim 9, wherein the vertical member portion has a fixed vertical height.

* * * * *